US006350018B1

(12) United States Patent
Waggoner

(10) Patent No.: US 6,350,018 B1
(45) Date of Patent: Feb. 26, 2002

(54) INK JET DROP EJECTION ARCHITECTURE FOR IMPROVED DAMPING AND PROCESS YIELD

(75) Inventor: Karen Wytmans Waggoner, Carlsbad, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/793,202

(22) Filed: Feb. 23, 2001

(51) Int. Cl.[7] ..... B41J 2/05; B41J 2/175; B41J 2/17

(52) U.S. Cl. ..... 347/65; 347/93; 347/94

(58) Field of Search ..... 347/63, 65, 93, 347/94, 44, 47, 67

(56) References Cited

U.S. PATENT DOCUMENTS 4,967,208 A * 10/1990 Childers ..... 347/47
5,463,413 A 10/1995 Ho et al. ..... 347/65
5,666,143 A 9/1997 Burke et al. ..... 347/65
5,734,399 A * 3/1998 Weber et al. ..... 347/65
6,007,188 A * 12/1999 MacLeod et al. ..... 347/65

* cited by examiner

*Primary Examiner*—John Barlow
*Assistant Examiner*—Juanita Stephens
(74) *Attorney, Agent, or Firm*—Manuel Quiogue

(57) ABSTRACT

An ink jet printhead that includes a thin film substructure having heater resistors formed therein, an ink barrier layer disposed one the thin film substructure, a plurality of ink chambers formed in said ink barrier, a plurality of ink channels respectively fluidically connected to the ink chambers and opening towards an ink feed edge, a plurality of elongated angled barrier islands extending from the feed edge into respective ink channels, and a plurality of non-elongated barrier islands alternatingly located with the non-linear elongated barrier island along the ink feed edge.

15 Claims, 2 Drawing Sheets

INK JET DROP EJECTION ARCHITECTURE FOR IMPROVED DAMPING AND PROCESS YIELD

BACKGROUND OF THE INVENTION

The disclosed invention is generally directed to ink jet printheads employed in ink jet printers, and more particularly to printheads having an ink barrier architecture that controls damping of ink flow.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. Ink is fed from one or more ink reservoirs to the various ink chambers around ink feed edges that can comprises sides of the thin film substructure or sides of ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. Nos. 4,719,477 and 5,317,346, both of which are incorporated herein by reference.

Considerations with ink jet printheads include puddling on the nozzle plate which can affect print quality and reliability.

SUMMARY OF THE INVENTION

The disclosed invention is directed to an ink jet printhead that includes a thin film substructure having heater resistors formed therein, an ink barrier layer disposed on the thin film substructure, a plurality of ink chambers formed in said ink barrier, a plurality of ink channels respectively fluidically connected to the ink chambers and opening towards an ink feed edge, a plurality of elongated angled barrier islands extending from the feed edge into respective ink channels, and a plurality of non-elongated barrier islands alternatingly located with the non-linear elongated barrier islands along the ink feed edge.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
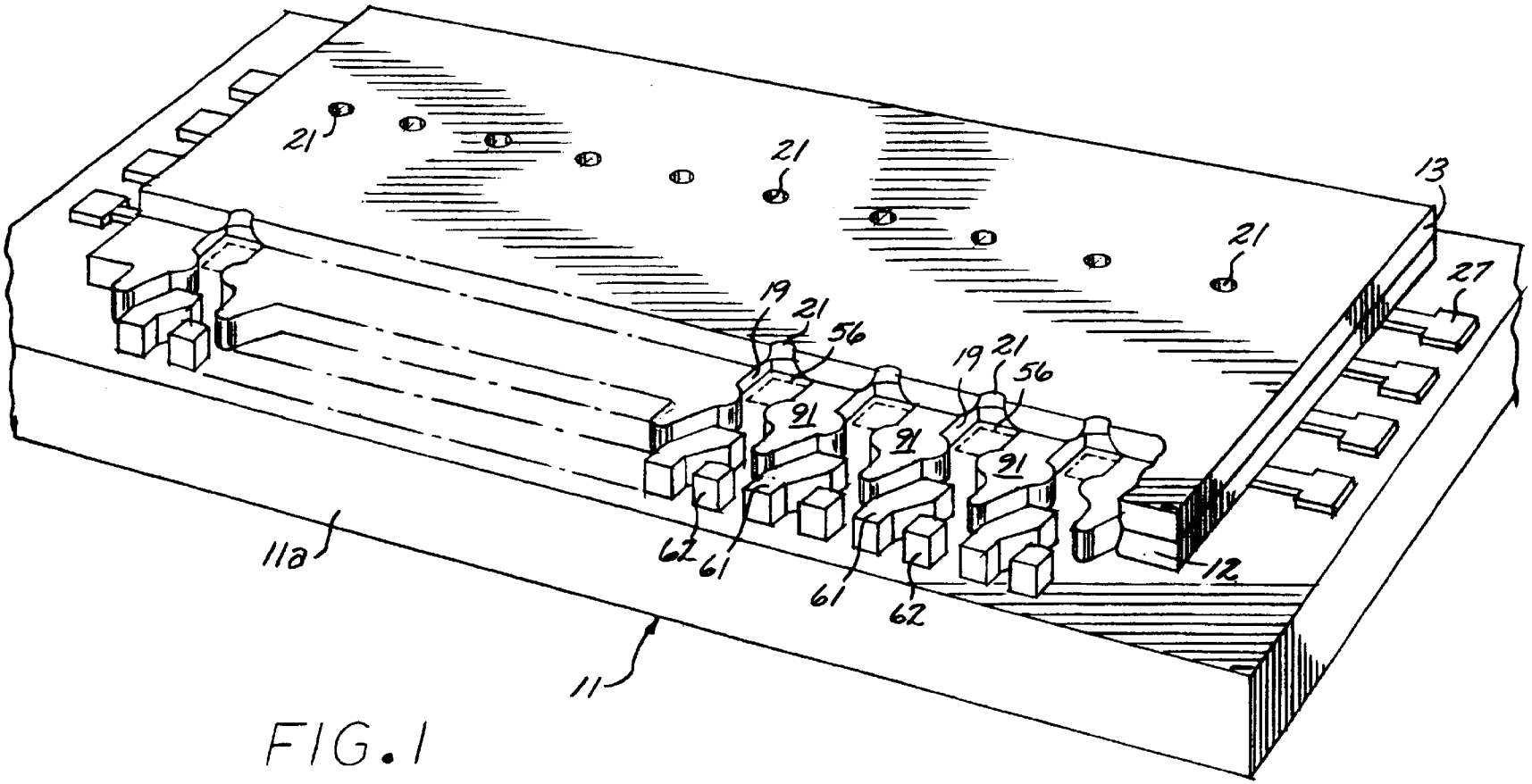
FIG. 1 is a schematic, partially sectioned perspective view of an ink jet printhead that employs the invention.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12.

The thin film substructure 11 is formed pursuant to integrated circuit fabrication techniques, and includes thin film heater resistors 56 formed therein. By way of illustrative example, the thin film heater resistors 56 are located in rows along longitudinal ink feed edges 11*a* of the thin film substructure 11.

The ink barrier layer 12 is formed of a dry film that is heat and pressure laminated to the thin film substructure 11 and photodefined to form therein ink chambers 19 and ink channels 29. Gold bond pads 27 engagable for external electrical connections are disposed at the ends of the thin film substructure 11 and are not covered by the ink barrier layer 12. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56 formed in the thin film substructure 11, and each ink chamber 19 is defined by the edge or wall of a chamber opening formed in the barrier layer 12. The ink channels 29 are defined by further openings formed in the barrier layer 12, and are integrally joined to respective ink firing chambers 19. Elongated angled barrier islands 61 respectively associated with the ink channels and non-elongated barrier islands 62 are formed in the barrier layer 12 at alternating locations adjacent the ink feed edge 11*a*.

The orifice plate 13 includes orifices 21 disposed over respective ink chambers 19, such that an ink firing resistor 56, an associated ink chamber 19, and an associated orifice 21 form an ink drop generator. By way of illustrative example, each orifice 21 can be offset relative to the associated heater resistor 56, wherein the orifice is not centered on the heater resistor, as schematically depicted in FIG. 2.

Figure 2:
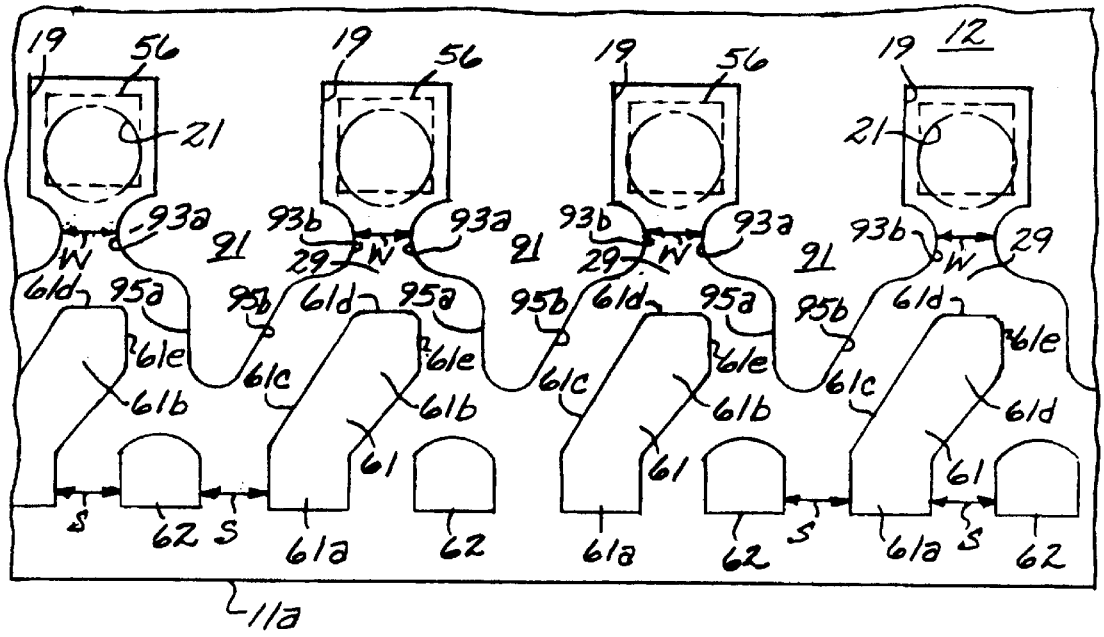
FIG. 2 is an unscaled schematic top plan view illustrating the configuration of a plurality of representative ink chambers, ink channels, and barrier islands of the printhead of FIG. 1.

FIG. 2 is an unscaled schematic top plan view illustrating the configuration of a plurality of representative ink chambers 19, associated ink channels 29, elongated angled barrier islands 61, and non-elongated barrier islands 62.

Each ink channel 29 is formed by walls of barrier projections 91 that extend from regions between the ink chambers 19 toward the ink feed edge 11*a*. Each barrier projection 91 includes lobe walls 93*a*, 93*b* at the inlets to the ink chambers 19 that are on either side of a barrier projection, and tip walls 95*a*, 95*b* that extend from the lobe walls 93*a*, 93*b* toward the ink feed edge 11*a*. In this manner, the sides of an ink channel 29 are more particularly formed of opposing lobe walls 93*a*, 93*b* at the entrance to an ink chamber 19, and barrier tip walls 95*a*, 95*b* that extend from the lobe walls toward the feed edge 11*a*. By way of illustrative example, a first tip wall 95*a* is generally orthogonal to the ink feed edge while a second tip wall 95*b* diverges from the opposing first tip wall 95*a* with which it forms an ink channel. The second tip wall 95*b* is thus oblique relative to the ink feed edge 11*a*.

Each elongated angled barrier island 61 extends non-linearly from the ink feed edge 11*a* into the portion of the associated ink channel that is between the tip walls 95*a*, 95*b*. For example, the elongated barrier island comprises a first portion 61*a* adjacent the ink feed edge 11*a* and generally orthogonal to the ink feed edge, and a second portion 61*b* that is longer than the first portion 61*a* and forms an obtuse angle therewith so as to be oblique to the feed edge 11*a*. The longitudinal extent of the second portion 61*b* can be generally parallel to the associated second tip wall 95*b*.

By way of more specific example, the second portion 61*b* of an elongated angled barrier island is generally parallel to an adjacent second tip wall 95*b* and includes one side 61*c* that is generally parallel to the adjacent second tip wall 95*b*. The second portion 61*b* also includes a barrier island tip formed of a first side 61*d* that is generally orthogonal to the feed edge 11*a* and a second side 61*e* that is generally orthogonal to the first side 61*d* and generally parallel to the adjacent first tip wall 95*a*.

Generally, the second portion 61*b* of the elongated barrier island 61 extends into the ink channel obliquely so as to form an asymmetrical Y-shaped channel between the ends of the barrier tip walls and the inlet to the ink chamber.

Each of the non-elongated barrier islands 62 extends orthogonally from an ink feed edge 11*a*, and is similar in shape to the first portion 61*a* of the elongated barrier island 61. Each non-elongated barrier island is further located adjacent an associated barrier tip and displaced therefrom obliquely relative to the ink feed channel 11*a*. In this manner, the non-elongated barrier islands 62 and the elongated barrier islands 61 are alternatingly located along the ink feed edge 11*a*. The elongated angled barrier islands 61 and the non-elongated barrier islands 62 can be uniformly spaced along the ink feed edge 11*a*.

By way of specific example, the width of each of the non-elongated barrier islands 62 as measured along the extent of the ink feed edge 11*a* is substantially the same as the width of each of the first portions 61*a* of the elongated angled barrier islands 61*b*. Also, the length of each of the non-elongated barrier islands 62 as measured orthogonally to the extent of the ink feed edge 11*a* is substantially the same as the length of each of the first portions 61*a* of the elongated angled barrier islands 61*b*.

By way of further example, for preventing particles from reaching the inlets to the ink chambers, the spacing S between adjacent islands 61, 62 along the feed edge can be less than the width W of the "pinchpoint" which is narrowest region between opposing lobe walls 93*a*, 93*b* that form an inlet to an ink chamber.

The foregoing has thus been a disclosure of a barrier island structure for an ink jet printhead that can provide for improved damping which reduces puddling, and which can be reliably made with reduced processing damage.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printhead, comprising:

a thin film substrate including a plurality of thin film layers and an ink feed edge;

a plurality of ink firing heater resistors defined in said plurality of thin film layers;

an ink barrier layer disposed on said thin film substrate;

respective ink chambers formed in said ink barrier layer over respective thin film resistors;

respective nozzles disposed over respective ink chambers and heater resistors;

respective ink feed channels connected to said ink chambers;

respective elongated barrier islands extending non-linearly from said ink feed edge into said ink feed channels; and respective non-elongated barrier islands located between said elongated barrier islands adjacent said feed edge.

2. The ink jet printhead of claim 1 wherein each of said elongated barrier islands comprises:

a first portion adjacent said ink feed edge; and a second portion that extends non-linearly from said first portion into associated ink feed channels.

3. The ink jet printhead of claim 2 wherein each of said ink feed channels includes a barrier wall that is oblique to said feed edge, and wherein said first portion of each of said elongated barrier island s is oblique to said ink feed edge.

4. The ink jet printhead of claim 3 wherein said first portion of each said elongated barrier islands is generally parallel to said oblique barrier wall.

5. The ink jet printhead of claim 2 wherein each of said ink feed channels and a second portion of an associated elongated barrier island form an asymmetrical Y-shaped channel.

6. The ink jet printhead of claim 2 wherein said first portion of each of said elongated barrier islands is of about the same width as each of said non-elongated barrier islands as measured parallel to said ink feed edge.

7. The ink jet prinhead of claim 2 wherein said first portion of each of said elongated barrier islands is of about the same length as each of said non-elongated barrier islands as measured orthogonally to said ink feed edge.

8. The ink jet printhead of claim 1 wherein said elongated barrier islands and said non-elongated barrier islands are uniformly spaced along said ink feed edge.

9. The ink jet printhead of claim 1 wherein said respective nozzles are offset relative to respective heater resistors.

10. An ink jet printhead comprising:

a thin film substrate including a plurality of thin film layers and an ink feed edge;

a plurality of ink firing heater resistors defined in said plurality of thin film layers;

an ink barrier layer disposed on said thin film substrate;

respective ink chambers formed in said ink barrier layer over respective thin film resistors;

respective nozzles disposed over respective ink chambers and heater resistors;

respective ink feed channels connected to said ink chambers;

respective elongated angled barrier islands extending from said ink feed edge into said ink feed channels; and respective non-elongated barrier islands located between said elongated barrier islands adjacent said feed edge.

11. The printhead of claim 10 wherein said elongated angled barrier islands comprise first portions located adjacent said ink feed edge and second portions that form an obtuse angle with said first portions, and wherein said first portions of said elongated barrier islands and said non-elongated barrier islands are substantially uniformly spaced along said ink feed edge.

12. The ink jet printhead of claim 11 wherein each of said first portions of said elongated angled barrier islands is of about the same width as each of said non-elongated barrier island as measured parallel to said ink feed edge.

13. The ink jet prinhead of claim 11 wherein each of said first portions of each of said elongated non-elongated barrier islands is of about the same length as each of said non-elongated barrier islands as measured orthogonally to said ink feed edge.

14. The ink jet printhead of claim 10 wherein said elongated angled barrier islands and said non-elongated barrier islands are uniformly spaced along said ink feed edge.

15. The ink jet printhead of claim 10 wherein said respective nozzles are offset relative to respective heater resistors.

* * * * *